US009211652B2

(12) United States Patent
Mäkiaho et al.

(10) Patent No.: US 9,211,652 B2
(45) Date of Patent: Dec. 15, 2015

(54) APPARATUS AND METHOD FOR PRODUCING LAYERED MATS

(75) Inventors: Juuso Mäkiaho, Lahti (FI); Achim Iredi, Bad Münder (DE)

(73) Assignee: IKEA Supply AG, Prattein (CH)

( * ) Notice: Subject to any disclaimer, the term of this patent is extended or adjusted under 35 U.S.C. 154(b) by 135 days.

(21) Appl. No.: 14/238,779

(22) PCT Filed: Aug. 3, 2012

(86) PCT No.: PCT/EP2012/065301
§ 371 (c)(1),
(2), (4) Date: Mar. 17, 2014

(87) PCT Pub. No.: WO2013/023943
PCT Pub. Date: Feb. 21, 2013

(65) Prior Publication Data

US 2014/0203470 A1 Jul. 24, 2014

(30) Foreign Application Priority Data

Aug. 17, 2011 (EP) ..... 11006734

(51) Int. Cl.
*B27N 3/14* (2006.01)
*B07B 1/14* (2006.01)

(52) U.S. Cl.
CPC .... *B27N 3/14* (2013.01); *B07B 1/14* (2013.01)

(58) Field of Classification Search
CPC ..... B27N 3/14; B27N 3/143; B07B 1/14
See application file for complete search history.

(56) References Cited

U.S. PATENT DOCUMENTS 3,487,911 A 1/1970 Wirz
4,068,991 A 1/1978 Ufermann et al.

(Continued)

FOREIGN PATENT DOCUMENTS

DE 42 13 928 A1 11/1993
DE 102 06 595 A1 8/2003
DE 10 2010 038 434 A1 1/2012
EP 0 860 255 A1 8/1998
WO 2011/082797 A1 7/2011

OTHER PUBLICATIONS

International Search Report and Written Opinion for corresponding International Application No. PCT/EP2012/065301 mailed Sep. 7, 2012.

(Continued)

*Primary Examiner* — Mary F Theisen
(74) *Attorney, Agent, or Firm* — Renner, Otto, Boisselle & Sklar, LLP

(57) ABSTRACT

The invention relates to an apparatus for forming a layered mat of non-oriented particles in a particle board production process, comprising first rollers for size-fractionating a continuous stream of particles into a first and a second fraction; second rollers arranged lower than the first rollers, to receive the first fraction, the second rollers being capable of further size-fractionating said first fraction; and third rollers arranged lower than the second rollers, for receiving said second fraction, the third rollers being capable for further size-fractionating said second fraction; the apparatus further comprising a receiving surface, movable along a longitudinal dimension of the apparatus, and arranged to receive said fractionated first fraction and said fractionated second fraction from said second and third rollers, at different longitudinal positions; wherein the first rollers and the third rollers are pin-type rollers.

15 Claims, 3 Drawing Sheets

(56) References Cited

U.S. PATENT DOCUMENTS

| | | | | |
|---|---|---|---|---|
| 5,386,914 | A * | 2/1995 | Eramaja | B27N 3/14 209/235 |
| 6,399,001 | B1 * | 6/2002 | Laatikainen | B27N 3/14 264/113 |
| 7,004,300 | B2 | 2/2006 | Bossler | |

OTHER PUBLICATIONS

Extended European Search Report for corresponding European Application No. 11006734.5 dated Feb. 23, 2012.

* cited by examiner

APPARATUS AND METHOD FOR PRODUCING LAYERED MATS

This application is a national phase of International Application No. PCT/EP2012/065301 filed Aug. 3, 2012 and published in the English language, which claims priority to EP 11006734.5 filed Aug. 17, 2011.

FIELD OF THE INVENTION

The present invention relates to apparatuses and methods for forming layered mats of non-oriented particles in high-throughput particle board production processes.

BACKGROUND OF THE INVENTION

Particle boards are widely used, e.g., in the furniture and construction industry. Typically, particle boards are made from lignocellulosic particles, such as wood chips, strands of wood, splinters, sawdust and/or lignocellulosic fibers, which particles are first admixed (or coated) with a thermally activatable binder. Generally, a mixture of the lignocellulosic particles and binder is prepared and then distributed on a horizontal receiving surface to form a mat. The mat is subsequently pressed under a temperature, sufficiently elevated to activate the binder. When the mat of binder-coated particles is subjected to heating and compression, the binder is activated (i.e., caused to flow and/or set) and binds the particulate material, to form a coherent sheet or board. After the pressing step, the compressed board or sheet is cooled and trimmed, to form the final product. Such processes are generally known.

It is sometimes desirable that the particle board comprises multiple layers. For example, it is known to use a set of rollers for fractionating particles according to size, thereby obtaining a particle board having at its outer surface layers, e.g., a fraction of finer particles, whereas the larger particles are distributed preferentially at the inner (core) layers of the product. Particle boards having a finer fraction of particles at the outer surface are sometimes aesthetically preferred, since they tend to have a smoother outer surface. A smooth outer surface can be advantageous, if a further layer, e.g. a furnace, is to be added to the particle board. Such products are known from U.S. Pat. No. 4,068,991.

In other cases, it is desirable that the larger particles are primarily in the outer surface layers of the board, while the small particles are primarily in the central layer(s) of the board. Such particle boards are also generally known.

The distribution of the particles in various layers, e.g., according to size, has great impact on the mechanical properties of the final product. Large particles at the surface layers of a multi-layer product generally results in a particle board having a higher flexural resistance, as compared to non-layered particle boards.

In order to further improve the mechanical properties of the particle board, it is known to provide oriented layers of elongated particles in so-called oriented strand boards (OSB). Oriented layers of particles increase the flexural resistance of the board, in particular, in the direction of orientation. In OSB boards, the larger particles are normally at the outer layers, and oriented in the longitudinal direction of the board, e.g., in the direction of production, while the smaller particles in the core layers are oriented in the transverse (lateral) direction, or they are not oriented at all. It is known to use disc-rollers for orienting particles in OSB boards, as is described, e.g., in U.S. Pat. No. 7,004,300 and U.S. Pat. No. 4,068,991.

EP 0860255 A1 discloses a procedure and an apparatus for producing OSB boards in which oriented layers of relatively large particles are at the upper and lower surface layers of the board. The relatively small particles are preferentially in the core layers of the board, oriented in the transverse (lateral) direction. EP 0860255 A1 uses a first and a second set of rollers for fractionating the particles according to size, and a third set of rollers, referred to as an "orienting mechanism", for orienting the particles in the desired direction. In the orienting mechanism, a set of disc-type rollers is used for orienting the larger particles in the lengthwise direction, while relatively smaller particles are oriented in the transverse direction by star-rollers, separated from each other by deflecting plates. This construction comprising two sets of rollers for size fractionation and an additional orienting mechanism does not allow for the production of a particle mat with homogeneously distributed particles in the horizontal and good size separation into vertical layers at very high throughput.

DE 4213928 A1 discloses an apparatus for scattering particles onto a moving belt for forming a particle mat. In one embodiment, a first set of two star-type rollers is used to mix and distribute incoming particles. The two star-type rollers rotate in opposite directions. Particles fall from the two star-type rollers onto two second sets of disc rollers, the two sets rotating in opposite directions. The disc rollers of the second sets separate the particles according to size, such that the larger particles are transported in the laterally outward directions, while smaller particles tend to fall through the disc rollers. The particles fall from the second sets of rollers onto third sets of rollers, which rotate opposite to the rotational direction of the second set of rollers from which they receive the particles, thereby transporting the larger particles laterally inward again. As a result of the rotation of the second and third sets of rollers in opposite directions, a central mixing zone is established in which a mixture of fine and large particles is added to the mat. An efficient separation of the fine and the larger particles is thus not achieved. Furthermore, the construction employing size separation in two opposite directions does not allow for the production of multi-layered mats at very high throughput. Furthermore, the types of rollers used in the first, second and third sets of rollers do not support very high throughput.

DE 10 2010 038 434 A1 discloses an apparatus for producing an oriented strand mat. The apparatus includes three sets of rollers rotating in the same direction. The first set of rollers consists of star-type rollers, and the second set of rollers consists of disc rollers. The choice of rollers in the first and second sets, as well as their spatial orientation relative to each other does not support the production of a particle mat at very high throughput.

Orientation of particles in the upper and lower surface layers of a particle board is not always desirable. In particular, if flexural resistance of a board in all dimensions is desired, orientation of the particles may be disadvantageous. Furthermore, the surface structure of OSB boards is often inferior to the one of non-oriented particle boards. This is of particular relevance in the furniture industry.

The known apparatuses and methods for producing layered, non-oriented particle boards are limited with respect to production speed, homogeneity of the layers, and with respect to the quality of separation of the particles according to size. Methods and apparatuses which are capable of running at a sufficiently high throughput or speed, very often do not fulfill the current needs of the industry with respect of homogeneity and quality of separation according to size. The current invention addresses these needs.

Hence, it is an object of the present invention to provide an apparatus and method for producing a layered, non-oriented mats in a particle board production process, which apparatus or method are capable of producing the mats at very high speed, while still a sufficiently high homogeneity (in the horizontal dimension) and a sufficiently high quality of separation according to size is ascertained in the final product.

SUMMARY OF THE INVENTION

It was found by the inventors of the present invention that a layered mat of particles can be formed at very high production speed, and yet with a sufficiently high level of homogeneity, and with good quality of separation of the particles according to size, if a two-step fractionation process is applied. In a first fractionation step, using a first set of fractionating pin-rollers, the incoming stream of particles is separated into a relatively finer and a relatively coarser fraction of particles at very high speed. The two fractions of finer and coarser particles are then separated separately, using a second set of rollers for the finer fraction, and a third set of (pin-type) rollers for the coarser fraction of particles. Without wishing to be bound by theory, it is believed that by first dividing the incoming stream of particles into a finer and a coarser fraction of particles, using an appropriate set of rollers, and then fractionating the finer and the coarser fraction separately on separate sets of rollers, a very high throughput can be achieved while still ascertaining a high level of homogeneity and good size-separation.

The invention relates to:

1. An apparatus for forming a layered mat of non-oriented particles in a particle board production process, said apparatus having a longitudinal (Y), a lateral (X), and a vertical dimension (Z), said apparatus comprising:

a source 1 for providing a continuous stream of particles;

a first set of rollers 2 arranged at a first vertical level, and capable of fractionating said continuous stream of particles into a first and a second fraction of particles, wherein said first fraction of particles has a smaller average particle size than said second fraction of particles;

a second set of rollers 3 arranged at a second vertical level, lower than said first vertical level, to receive said first fraction of particles, said second set of rollers 3 being capable of further fractionating said first fraction of particles according to size; and a third set of rollers 4 arranged at a third vertical level, lower than said second vertical level, for receiving said second fraction of particles, said third set of rollers 4 being capable of further fractionating said second fraction of particles according to size;

said apparatus further comprising a receiving surface 5, movable along the longitudinal dimension of the apparatus, and arranged to receive said fractionated first fraction and said fractionated second fraction from said second 3 and third 4 set of rollers, at different longitudinal positions on said receiving surface 5;

wherein the rollers of said first set of rollers 2 and the rollers of said third set of rollers 4 are pin-type rollers.

In preferred embodiments of the invention, the second set of rollers is arranged to receive said first fraction of particles from said first set of rollers. More preferably, said second set of rollers is arranged to receive said first fraction of particles directly from said first set of rollers. Likewise, in preferred embodiments of the invention, the third set of rollers is arranged to receive said second fraction of particles from said first set of rollers, or, more preferably, the third set of rollers is arranged to receive said second fraction of particles directly from said first set of rollers. The expression "directly" means that no further rollers, or sets of rollers, or other elements, are arranged between the first and the second and/or between the first and the third set of rollers, respectively.

In other preferred embodiments of the invention, the second set of rollers is arranged at said second vertical level to receive said first fraction of particles but not said second fraction; and said third set of rollers 4 is arranged at said third vertical level for receiving said second fraction of particles, but not said first fraction of particles.

Preferably, the rollers of the third set of rollers 4, and optionally also the first set of rollers 2 comprise row-type pin rollers, in which the tangent lines 12 of trajectories 13 on which the rows of pins are arranged, in a cross-sectional plane normal to the axis of rotation of the roller, at the intersections 14 with an imaginary cylinder 15 having a radius r equal to the radius of the respective roller, are angled away from the radially outward directions 16 by an angle β, in a direction opposite the direction of rotation 20 of the roller, wherein β is between 0° and 90°.

In particularly preferred embodiments, β is between 0° to 60°, or 0° to 45°, or 5° to 45°, most preferred 10° to 35°.

2. Apparatus of #1, wherein the rollers of said first, second and third set of rollers 2, 3, 4 rotate in a common rotational direction.

3. Apparatus as defined above, wherein said second set of rollers 3 is movably mounted for horizontal movement along the longitudinal (Y) dimension of said apparatus.

4. Apparatus as defined above, wherein said first set of rollers 2 is angled away from the horizontal.

5. Apparatus as defined above, wherein the greatest of all radii of the rollers of said second set of rollers 3 is smaller than the smallest of all radii of the rollers of said first 2 and third 4 set of rollers.

6. Apparatus as defined above, wherein the rollers of said second set of rollers 3 are drum-type rollers, or have a continuous circumferential surface area.

7. Apparatus as defined above, wherein the orthogonal projection of each said first, second and third sets of rollers 2, 3, 4 onto a horizontal plane defines a first, a second and a third (rectangular) projection area, respectively, and wherein said first and said second projection areas, as well as said first and said third projection areas overlap, respectively, in said horizontal plane. Preferably, also the second and the third projection areas overlap in said horizontal plane.

8. Apparatus as defined above, wherein the direction of movement of particles on each set of rollers defines a forward direction along the longitudinal dimension (Y) of the apparatus, wherein the foremost roller 6 of said first set of rollers 2 is arranged longitudinally forward the foremost roller 7 of said second set of rollers 3; and wherein the foremost roller 8 of said third set of rollers 4 is arranged longitudinally forward the foremost roller 6 of said first set of rollers 2.

9. Apparatus of #8, wherein the foremost roller 7 of said second set of rollers 3 is arranged at a first intermediate longitudinal position between the longitudinal position of the foremost roller 6 of said first set of rollers 2 and the longitudinal position of the rearmost roller 9 of said first set of rollers 2.

10. Apparatus of #9, wherein the rearmost roller 10 of said third set of rollers 4 is arranged at a second intermediate longitudinal position between the longitudinal position of the foremost roller 6 of said first set of rollers 2 and the longitudinal position of the rearmost roller 9 of said first set of rollers 2.

11. Apparatus of #10, wherein said second intermediate longitudinal position is longitudinally forward said first intermediate longitudinal position. The longitudinal position of a roller, in this case, is the position of the roller's axis of rotation in the longitudinal dimension.

12. An apparatus for forming a symmetrical layered mat of non-oriented particles in a particle board production process, said apparatus comprising two apparatuses of any one of #1 to #11, arranged in opposite orientation.

13. A method of forming a layered mat of non-oriented particles in a particle board production process, said method comprising:

providing a continuous stream of particles;

fractionating said continuous stream of particles into a first and a second fraction of particles by a first set of rollers 2, arranged at a first vertical level, wherein said first fraction of particles has a smaller average particle size than said second fraction of particles;

receiving said first fraction of particles by a second set of rollers 3 arranged at a second vertical level, lower than said first vertical level, and further fractionating said first fraction of particles according to size by said second set of rollers 3;

receiving said second fraction of particles by a third set of rollers 4 arranged at a third vertical level vertically below said second vertical level, and further fractionating said second fraction of particles according to size by said third set of rollers 4; and receiving said fractionated first second fractions from said second 3 and third 4 set of rollers on a receiving surface 5, movable along the longitudinal (Y) dimension of the apparatus, and arranged to receive said particles of said fractionated first and second fraction at different positions in said longitudinal dimension on said receiving surface 5;

wherein the rollers of said first set of rollers 2 and of said third set of rollers 4 are pin-type rollers.

14. Method of #13, wherein said first set of rollers 2 is angled away from the horizontal.

15. Method of #13, wherein an apparatus of any one of #1 to #12 are used.

DETAILED DESCRIPTION OF THE INVENTION

Figure 1:
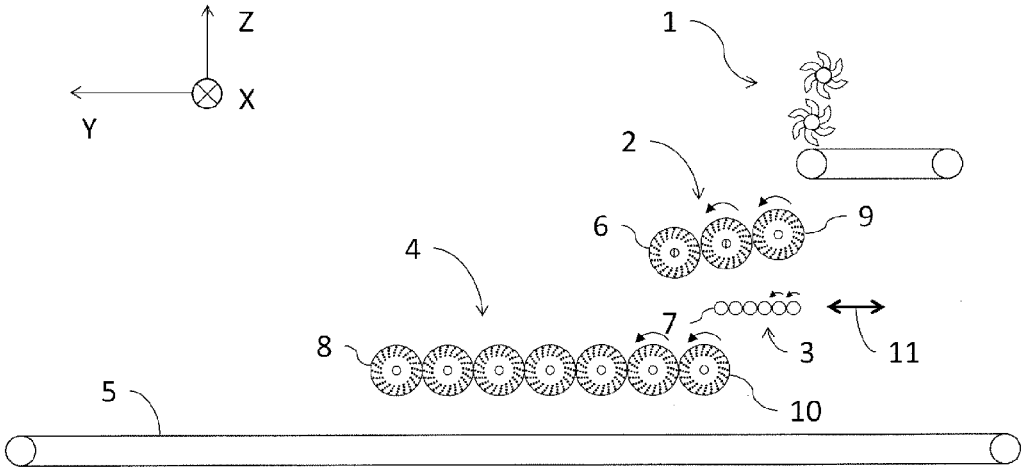
FIG. 1 shows schematically a side view of an apparatus for producing a layered mat, according to the invention.

A "set of rollers", according to the invention, shall be understood as being a plurality of, or a row of, adjacent rollers, all rollers of the set being arranged for rotation around parallel axes. Preferably, the distance between the axes of each two adjacent rollers is less than 1.5, 1.2, 1.1, 1.01, or 1.001 times the sum of the radii of the respective adjacent rollers. Alternatively, the distance between each two adjacent rollers is less than 10 cm, preferably less than 5 cm, 2 cm, 1 cm, 5 mm, 2 mm, or less than 1 mm.

In the context of the present invention, the "radius" or the "diameter of a roller" shall be understood as being the minimum radius or diameter of an imaginary cylinder surrounding all points on the roller's outer surface. Accordingly, the radius of a cylindrical roller is the radius of its cylindrical surface. On the other hand, the radius of a roller having an irregularly shaped outer surface is equal to the maximum radial distance between a point of the roller's outer surface and its axis of rotation.

In one embodiment of the invention, the axes of the rollers of the first, second, and third set of rollers lie in plane, respectively. In another embodiment, the rollers, unless otherwise stated, lie horizontally adjacent each other, i.e., the axes of rotation of all rollers of a particular set of rollers lie in the same horizontal plane. In one embodiment, the axes of rotation of the rollers of the second and third set of rollers lie in a horizontal plane, respectively, while the axes of the rollers of the first set of rollers lie on a tilted plane, i.e., angled away from the horizontal.

A set of rollers shall be understood as being "angled away from the horizontal", if the consecutive rollers of the set of rollers are arranged at monotonously increasing or decreasing vertical levels. A set of rollers shall be understood as being "angled away in the downward direction", if the consecutive rollers of the set of rollers, in the forward direction, are arranged at monotonously decreasing vertical levels. Preferably, the first set of rollers is angled away from the horizontal in the downward direction. In other embodiments, first, second and third sets of rollers are angled away from the horizontal, e.g., in the downward direction. Hence, the rolls of the first set of rollers are preferably arranged such that the vertical level of consecutive rollers of the first set of rollers decreases in the "forward direction" (i.e., in the direction of movement of the particles over the set of rollers). In very preferred embodiments of the invention, the angle by which the first (and optionally the second and third) set of rollers can be angled away from the horizontal, is adjustable.

A "pin-type roller", in accordance with the present invention, shall be understood as being a roller comprising multiple pins (or rods, or bars), preferably arranged in substantially parallel relationship to the axis of rotation of the roller, such that said pins, upon rotation of the roller, move on concentric circular paths around the axis of rotation of said roller. Preferred pin-type rollers are cage rollers, and spiral-shaped pin-type rollers. Spiral-shaped pin-type rollers are known, e.g., from DE 102 06 595.

A "cage roller" or "hamster roller", according to the invention, shall be understood as being a pin-type roller, in which multiple pins are arranged such that, in a cross-sectional plane, the multiple pins lie on preferably one, optionally multiple, concentric circle(s) around the axis of rotation of the roller. The pins of a cage roller can all be parallel to the axis of rotation of the roller, but the cage roller can also be twisted, such that, e.g., the pins of the roller angled with respect to the axis of rotation, or the individual pins may describe a helical path from one end of the roller to the other end. Cage rollers are well known from, e.g., U.S. Pat. No. 3,487,911.

In a preferred embodiment of the invention, the pin-type rollers of the invention comprise multiple rows of adjacent pins (or rods), said multiple rows of adjacent pins are arranged on trajectories which extend, seen in a cross sectional plane, from first, radially more outward positions towards a second, radially more inward positions. Such rollers are hereinafter referred to "row-type pin rollers".

Preferably, said rows of adjacent pins are arranged, seen in a cross-sectional plane, on curved or spiral-shaped trajectories from first, radially more outward positions towards second, radially more inward positions. It shall be understood that the trajectory need not necessarily extend all the way to the center (i.e., the axis of rotation of the roller), but may also extend only part of the way towards the center. This is exemplified in rollers 6, 8, 9, 10 of FIG. 1. In other preferred embodiments, the trajectories have no curvature, hence, the trajectory can also be a straight line.

Figure 3:
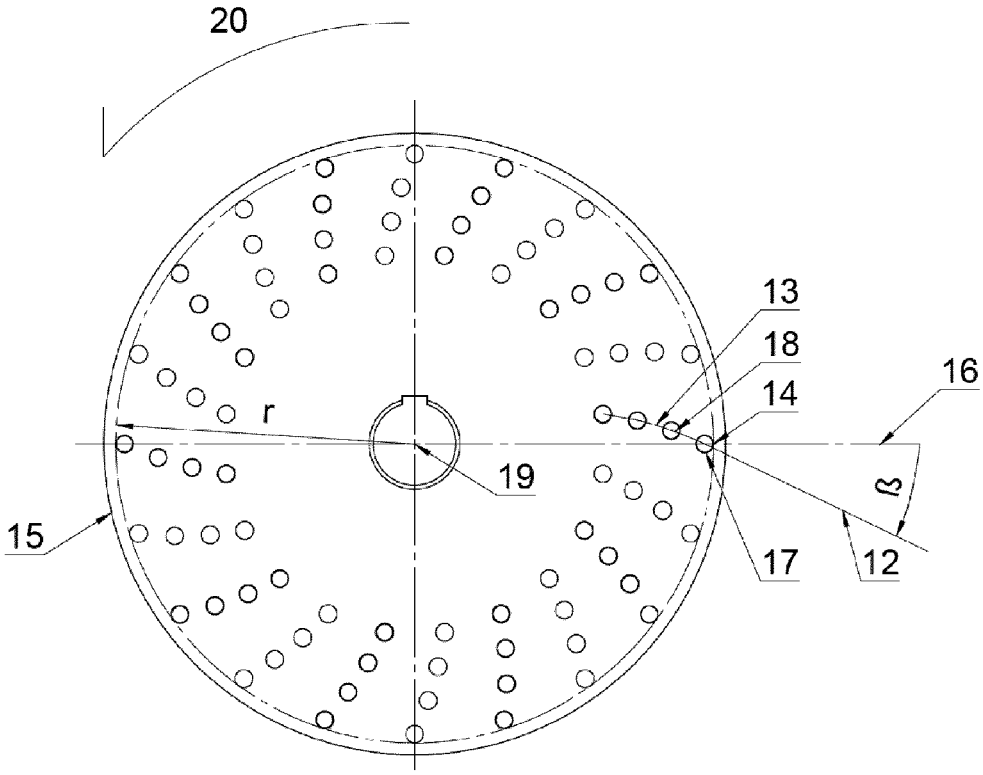
FIG. 3 visualizes the angle β in a spiral-shaped pin-type roller.

A particularly preferred embodiment is now described with reference to FIG. 3. In this embodiment, the rollers of the third set of rollers 4, optionally also of the first set of rollers 2 comprise row-type pin rollers in which the tangent lines 12 of the trajectories 13 (on which the rows of pins are arranged), at the intersections 14 with an imaginary cylinder 15 having a radius r equal to the radius of the roller, are angled away from the radially outward directions 16 by an angle β in a direction opposite the direction of rotation 20 of the roller (when the apparatus is in use), wherein β is between 0° and 90°. In particularly preferred embodiments, β is between 0° to 60°, or 0° to 45°, or 5° to 45°, most preferred 10° to 35°. In one embodiment of the invention, the tangent 12 is defined by the straight line through the centers of the two radially most outward pins 17, 18 of the respective row of pins.

Without wishing to be bound by theory, it is believed that this arrangement of pins in the roller leads to a greater amount of the kinetic energy being taken from incoming particles, whereby particles are more gently "laid" onto the mat, thereby producing a very homogenous, random distribution of the particles, even at very high particle throughput.

Pin-type rollers of the invention may also have rows of pins arranged, seen in a cross-sectional plane normal to the axis of rotation, on straight trajectories from a first, radially more outward position towards a second, radially more inward position.

A "drum-type roller", in the context of the present invention, shall be understood as being a roller having a continuous circumferential surface area, e.g., a cylindrical surface area, or, e.g., a cylindrical surface with a structured surface, e.g., with indents, cavities or grooves. Preferred drum-type rollers, in particular in connection with the second set of rollers, have a generally cylindrical surface area with pyramidal protrusions. According to the invention, a roller shall be understood as having a "continuous circumferential surface area", if all points on the outer surface of the roller are on the same surface, i.e., not on separate surfaces. Drum-type rollers can be hollow, but may also have a solid core. Hollow drum-type rollers are preferred. It shall be understood that pin-type rollers do not have a continuous circumferential surface area, thus, they are no drum-type rollers, according to the invention.

A "layered mat" (or "layered particle board"), according to the invention, shall be understood as being a mat of particles (or a particle board) having multiple layers of particles, wherein each adjacent two layers have distinct particle characteristics, e.g., a distinct particle size distribution, a distinct average particle size, or a distinct average density. The layers extend in the X and Y dimensions, i.e., they extend substantially parallel to the upper and lower surfaces of the mat (or particle board). The expression "layered mat", however, shall not be understood as implying discontinuous (step-wise) changes in the particle characteristics in the vertical direction. Instead, "layered mats" may have continuous changes in a particle characteristic provided that, e.g., the average particle size distribution, the average particle size, or the average density [kg/m$^3$] within one layer is different as compared to the ones of the adjacent layer(s). In such cases, the expression "layered mat" (or layered particle board) is understood as defining a mat (or particle board) showing a gradient in a particle characteristic, such as the particle size, the particle size distribution, or the density [kg/m$^3$] along the vertical (Z) dimension. Preferably, layers of mats (or particle boards) of the invention extend in the X and Y dimension of the mat (or board). In preferred embodiments, a layer has constant particle characteristics (such as the average particle size distribution, the average particle size, or the average density [kg/m$^3$]) along the X and Y dimension.

"Non-oriented", with respect to the particles in a mat or particle board, shall be mean that the particles of the mat (or layer, or board) are oriented randomly in all directions, at least randomly oriented in the X and Y dimensions of the mat (or layer, or board).

The invention shall now be described with reference to the appended drawings.

FIG. 1 shows a schematic view of an apparatus of the invention. The apparatus comprises a source of particles 1 for providing a preferably continuous stream of particles.

Preferred particles, in accordance with the present invention, are lignocellulosic particles, such as wood chips, strands of wood, sawdust, splinters, paper, and/or other lignocellulosic fibers. The constant stream of particles, according to the invention may also comprise particles of other materials. Particles are preferably mixed (or coated) with a thermally activatable synthetic binder. Preferred binders ate thermally activatable binders or resins. Preferred particle boards of the invention are wood-based panels.

In one embodiment, source 1 comprises a conveyor belt, as shown in FIG. 1, but it may also be in form of, e.g., an elongated chute or hopper, preferably arranged across the breadth of the apparatus. Source 1 may comprise one or multiple rollers for ascertaining a constant continuous flow of particles.

At a level vertically below source 1 there is provided a first set of rollers 2. First set of rollers 2 comprises multiple rollers arranged as a row of rollers, e.g., in a substantially horizontal direction. Rollers of the first set of rollers 2 are, however, preferably angled or tilted away from the horizontal, as is shown in FIG. 1. Angling the first set of rollers away from the horizontal increases the capacity of set of rollers, i.e., the amount of particles per unit time which can be processed is increased. It has surprisingly been found that angling the first set of rollers away from the horizontal leads to dramatically increased maximum production speed, while not compromising the size fractionating effect, or homogeneity of the mat dramatically.

Preferably, all rollers of the first set of rollers rotate in the same rotational direction. However, it is also possible that the foremost roller 6 rotates in the opposite direction, so that less particles fall from the terminal edge of set of rollers 2 (this also applies to the second and third sets of rollers mentioned below).

The first set of rollers preferably comprises 2 to 20, preferably 2 to 10, most preferably 3 to 7 rollers.

Rollers of the first set of rollers are preferably 50 to 1000 mm, preferably 150 to 600 mm, most preferred 200 to 500 mm in diameter.

Rollers of the first set of rollers preferably rotate at a rotational speed of 10 to 400 rpm, preferably 20 to 300 rpm, most preferred 30-150 rpm.

Particles falling onto first set of rollers 2 will be transported over the rollers of the first set of rollers 2 in a forward direction. The rollers are preferably spaced apart, such as to allow a certain fraction of particles to fall through the gap in between two adjacent rollers onto, e.g., a second set of rollers 3, or onto a third set of rollers 4. In addition, particles can also fall through gaps between adjacent pins of the pin-type rollers of the first set of rollers 2. It is apparent that relatively smaller particles have a greater likelihood of falling through a gap between the rollers (or between the pins of the rollers) than have the relatively larger particles. This leads to a the well known fractionating effect of such sets of rollers. This fractionating effect is exerted by the first set of rollers 2 to divide the large constant stream of incoming particles into a first fraction of particles and a second fraction of particles. The first fraction of particles contains the relatively smaller particles (e.g., as measured as the average particle size), whereas the second fraction of particles contains the relatively larger particles.

According to the invention, the stream of incoming particles can be as high as 200 to 10000 kg/h/m width of the mat, preferably 500 to 6000 kg/h/m width of the mat, most preferred 1000 to 5000 kg/h/m width of the mat.

According to the invention, the first fraction of particles falls onto a second set of rollers 3. This set of rollers is preferably adapted to efficiently fractionate relatively small particles according to size. This is achieved, e.g., by providing in second set of rollers 3 multiple adjacent rollers having a relatively small diameter. Rollers of the second set of rollers 3, according to the invention, have preferably a diameter of 10 to 500 mm, preferably 50 to 200 mm, most preferred 60 to 150 mm. Furthermore, it has shown that rollers having a continuous circumferential surface area are particularly advantageous when used in the second set of rollers 3. Preferably, the rollers of said second set of rollers (i.e., their axes) are arranged in a horizontal plane. Rollers of the second set of rollers 3 preferably all rotate in the same rotational direction. Rollers of the second set of rollers 3 are preferably drum-type rollers, e.g., having a generally cylindrical circumferential surface area having (e.g., pyramidal) indents.

The second set of rollers preferably comprises 2 to 50, preferably 3 to 30, most preferably 8 to 20 rollers.

Rollers of the second set of rollers preferably rotate at a rotational speed of 20 to 250 rpm, preferably 40 to 200 rpm.

The rotational speed (rpm) of the rollers of the first, second and third set of rollers is preferably adjustable for each roller individually, or for at least two groups of rollers separately. A group of rollers shall be understood as comprising at least two adjacent rollers of the same set. By adjusting the rotational speed of rollers individually, or in groups, the amount of particles being transported along a set of rollers, and the amount of particles falling through set of rollers, at certain positions, can be adjusted.

In one preferred embodiment of the invention, the second set of rollers is movably mounted for horizontal movement along the longitudinal dimension Y, relative to the first and third sets of rollers 2, 4. This is depicted in FIG. 1 by arrow 11. By providing a horizontally movable second set or rollers 3, the apparatus of the invention can be adjusted to various incoming particle streams, e.g., adjusted to the particle size distribution of the incoming particles, to a desired level of separation in the fraction of smaller particles, but also to the amount of incoming particles. A horizontally movable second set or rollers greatly increases the flexibility of the claimed apparatus with regard to the properties of the particle stream to be processed, and with regard to the desired process parameters. The second set of rollers 3 (i.e., their axes) is (are) preferably arranged in a horizontal plane.

Vertically below said first and second set of rollers 2 and 3 there is provided the third set of rollers 4. All rollers of the third set of rollers preferably rotate in the same direction of rotation. Preferred rollers of the third set of rollers are pin-type rollers, such as cage rollers or spiral-shaped pin-type rollers. The rollers of said third set of rollers (i.e., their axes) are preferably arranged to lie in a horizontal (X,Y) plane.

The third set of rollers preferably comprises 2 to 30, preferably 5 to 20, most preferred 6 to 10 rollers.

Rollers of the third set of rollers are preferably 20 to 500 mm, preferably 50 to 400 mm, most preferred 150 to 300 mm in diameter.

Rollers of the third set of rollers preferably rotate at a rotational speed of 10 to 300 rpm, preferably 30 to 200 rpm, most preferred 40 to 150 rpm.

Vertically below third set of rollers 4 there is provided a movable receiving surface (or movable support) 5, e.g., in form of a movable conveyor belt. Receiving surface 5 is movable along the longitudinal dimension Y of the apparatus. Receiving surface 5 may be movable along the longitudinal dimension in both directions (left/right in FIG. 1).

It is appreciated by the skilled person that all rollers of first, second and third set of rollers 2, 3, 4 are arranged for rotation around parallel axes, and that all said axes are arranged in the lateral direction, shown as the "X" dimension in FIG. 1. Preferably, all radii within the same set of rollers are the identical. Furthermore, rollers of said first 2, second 3 and third set of rollers 4 generally have substantially the same length in the lateral (X) dimension, which may be equal to the lateral extent of movable receiving surface 5.

It has shown that a very high throughput and at the same time a very homogeneous distribution and size separation of particles is only achieved when using pin-type rollers, such as cage rollers, spiral-shaped pin-type rollers and the like, in the third set of rollers 4. It was found by the present inventors that, surprisingly, it is particularly advantageously when the first and third sets of rollers 2, 4 both have only pin-type rollers (such as cage rollers, spiral-shaped pin-type rollers and the like). In particular, it was found that a far better size fractionating effect can be achieved at high material throughput, when pin-type rollers used in the third set of rollers, as compared to the situation where disc-type rollers are used in the third set of rollers 4. Disc-type rollers are useful for orienting particles for forming oriented strand boards (OSB) or oriented particles boards (OPB), but they were found to be unsuitable for application in methods and apparatuses of the invention, since they cannot handle high particle throughput. It is thus a key feature of the invention that pin-type rollers, not disc-type rollers, are used in the third set of rollers (and preferably also in the first set of rollers).

It has shown that the objectives of the present invention are best achieved, if—in the direction of movement of particles on each set of rollers (the forward direction)—the foremost roller 6 of the first set of rollers 2 is arranged longitudinally forwards the foremost roller 7 of the second set of rollers 3. Furthermore, the foremost roller 8 of the third set of rollers 4 is arranged longitudinally forward the foremost roller 6 of the first set of rollers 2. Moreover, it is advantageous that the foremost roller 7 of the second set of rollers 3 is arranged at a first intermediate longitudinal position between the longitudinal position of the foremost roller 6 of the first set of rollers 2 and the longitudinal position of the rearmost roller 9 of the first set of rollers 2. It is also advantageous that the rearmost roller 10 of the third set of rollers 4 is arranged at a second intermediate longitudinal position between the longitudinal position of the foremost roller 6 of the first set of rollers 2 and the longitudinal position of the rearmost roller 9 of said first set of rollers 2. Finally, it was found to be advantageous, if said second intermediate longitudinal position is longitudinally forward said first intermediate longitudinal position. (The longitudinal position of a roller, according to the invention, is defined by the position of its axis of rotation in the longitudinal dimension.)

It was surprisingly found that spiral-type pin rollers in the third (and optionally, in the first) set of rollers provide for the best homogeneity of particles in the layers of the resulting mat.

It is understood that in a single arrangement as shown in FIG. 1, depending on the direction of movement of receiving surface 5, the resulting mat will have the relatively larger particles in the upper or lower layer of the mat. If the receiving surface 5 in FIG. 1 moves towards the right-hand side, larger particles will primarily be in the upper surface layer, whereas if the receiving surface 5 in FIG. 1 moves to the left-hand side, the larger particles will preferentially be in the lower layers of the mat.

Figure 2:
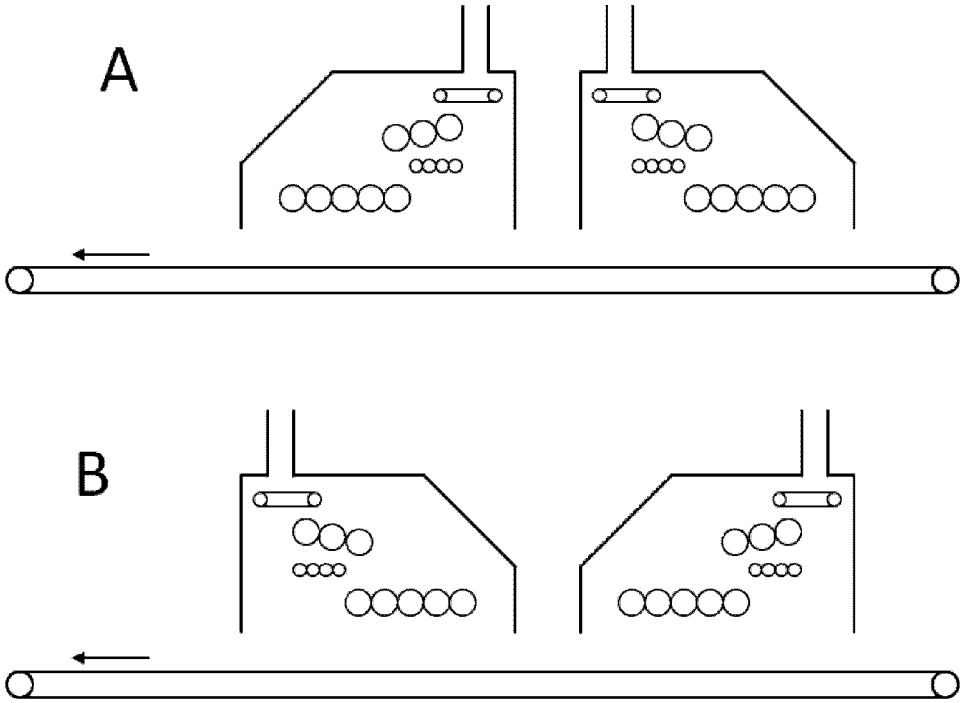
FIG. 2 shows schematically a side view of an apparatus for producing a symmetrical layered mat, according to the invention.

In order to produce symmetric mats (i.e., having a symmetric vertical profile in a particle characteristic, such as a symmetric density profile or a symmetric particle size profile), two of the arrangements shown in FIG. 1 are combined to a single forming station as schematically shown in FIG. 2. The forming station shown in FIG. 2A will produce mats for particle boards having the relatively larger particles at the upper and lower surface, whereas the forming station shown in FIG. 2B, in which the two separate forming units are arranged in respectively opposite direction, will produce a mat (or board) having the finer fraction of particles at the outer surface layers. Forming stations forming mats with larger particles at the outer layers (FIG. 2A) are preferred.

The invention claimed is:

1. An apparatus for forming a layered mat of non-oriented particles in a particle board production process, said apparatus having a longitudinal dimension (Y), a lateral dimension (X), and a vertical dimension (Z), wherein said apparatus comprises:

a source for providing a continuous stream of particles;

a first set of rollers arranged at a first vertical level and capable of fractionating said continuous stream of particles into a first and a second fraction of particles, wherein said first fraction of particles has a smaller average particle size than said second fraction of particles;

a second set of rollers arranged at a second vertical level, lower than said first vertical level, to receive said first fraction of particles, said second set of rollers being capable of further fractionating said first fraction of particles according to size; and a third set of rollers arranged at a third vertical level, lower than said second vertical level, for receiving said second fraction of particles, said third set of rollers being capable for further fractionating said second fraction of particles according to size;

wherein said apparatus further comprises a receiving surface, movable along the longitudinal dimension of the apparatus (Y), and arranged to receive said fractionated first fraction and said fractionated second fraction from said second and third set of rollers, at different longitudinal positions on said receiving surface;

wherein the rollers of said first set of rollers; and said third set of rollers are pin-type rollers.

2. Apparatus of claim 1, wherein the rollers of said first, second and third set of rollers rotate in the same rotational direction around their respective axes.

3. Apparatus of claim 1, wherein said second set of rollers is movably mounted for horizontal movement along the longitudinal dimension (Y) of said apparatus.

4. Apparatus of claim 1, wherein said first set of rollers is angled away from the horizontal.

5. Apparatus of claim 1, wherein the greatest of all radii of the rollers of said second set of rollers is smaller than the smallest of all radii of the rollers of said first and third set of rollers.

6. Apparatus of claim 1, wherein the rollers of said second set of rollers are drum-type rollers.

7. Apparatus of claim 1, wherein the orthogonal projection of each said first, second and third sets of rollers onto a horizontal plane defines a first, a second and third projection area, respectively, and wherein said first and said second projection areas, as well as said first and said third projection areas overlap, respectively, in said horizontal plane.

8. Apparatus of claim 1, wherein the direction of movement of particles on each set of rollers defines a forward direction along the longitudinal dimension (Y) of the apparatus, wherein the foremost roller of said first set of rollers is arranged longitudinally forward the foremost roller of said second set of rollers; and wherein the foremost roller of said third set of rollers is arranged longitudinally forward the foremost roller of said first set of rollers.

9. Apparatus of claim 8, wherein the foremost roller of said second set of rollers is arranged at a first intermediate longitudinal position between the longitudinal position of the foremost roller of said first set of rollers and the longitudinal position of the rearmost roller of said first set of rollers.

10. Apparatus of claim 9, wherein the rearmost roller of said third set of rollers is arranged at a second intermediate longitudinal position between said longitudinal position of said foremost roller of said first set of rollers and said longitudinal position of said rearmost roller of said first set of rollers.

11. Apparatus of claim 10, wherein said second intermediate longitudinal position is longitudinally forward said first intermediate longitudinal position.

12. An apparatus for forming a symmetrical layered mat of non-oriented particles in a particle board production process, said apparatus comprising two apparatuses as defined in claim 1, arranged in opposite orientation.

13. Method of forming a layered mat of non-oriented particles in a particle board production process, said method comprising:

providing a continuous stream of particles;

fractionating said continuous stream of particles into a first and a second fraction of particles by a first set of rollers arranged at a first vertical level, wherein said first fraction of particles has a smaller average particle size than said second fraction of particles;

receiving said first fraction of particles by a second set of rollers arranged at a second vertical level, lower than said first vertical level, and further fractionating said first fraction of particles according to size by said second set of rollers;

receiving said second fraction of particles by a third set of rollers arranged at a third vertical level lower than said second vertical level, and further fractionating said second fraction of particles according to size by said third set of rollers; and receiving said fractionated first and second fractions from said second and third set of rollers on a receiving surface, movable in a longitudinal dimension, and arranged to receive said fractionated first and second fractions at different positions in said longitudinal dimension on said receiving surface;

wherein the rollers of said first set of rollers and said third set of rollers are pin-type rollers.

14. Method of claim 13, wherein said first set of rollers is angled away from the horizontal.

15. Method of claim 13, wherein said second set of rollers is movably mounted for horizontal movement along the longitudinal dimension (Y) of said apparatus.

* * * * *